US006585350B2

(12) United States Patent
Barinaga

(10) Patent No.: US 6,585,350 B2
(45) Date of Patent: Jul. 1, 2003

(54) PRINTING MECHANISM MULTI-DIRECTIONAL WIPING TECHNIQUE

(75) Inventor: John A. Barinaga, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 26 days.

(21) Appl. No.: 09/915,073

(22) Filed: Jul. 25, 2001

(65) Prior Publication Data

US 2003/0020780 A1 Jan. 30, 2003

(51) Int. Cl.[7] ..... B41J 2/165
(52) U.S. Cl. ..... 347/33; 347/32
(58) Field of Search ..... 347/33, 29, 32, 347/3, 42

(56) References Cited

U.S. PATENT DOCUMENTS 5,051,761 A * 9/1991 Fisher et al. ..... 347/30
5,206,666 A * 4/1993 Watanabe et al. ..... 347/3
5,432,539 A * 7/1995 Anderson ..... 347/33
5,774,140 A 6/1998 English ..... 347/33
5,793,390 A * 8/1998 Claflin et al. ..... 347/33
5,798,775 A * 8/1998 Takahashi et al. ..... 347/33
5,953,025 A * 9/1999 Sakurai ..... 347/33
6,019,466 A * 2/2000 Hermanson ..... 347/104
6,109,725 A * 8/2000 Saikawa et al. ..... 347/33

FOREIGN PATENT DOCUMENTS

JP 404278358 A * 10/1992 ..... 347/33

* cited by examiner

*Primary Examiner*—Shin-wen Hsieh

(57) ABSTRACT

A printing mechanism includes a print module having a printhead, and includes a wiper assembly having a wiper to clean the printhead of ink residue when the wiper and the printhead are in contact and move relative to each other in a first direction. The wiper and the printhead also move relative to each other in a second direction to release a contact tension between the wiper and the printhead. The first direction and the second direction define an arc path that the wiper and/or printhead moves along to controllably release the wiper contact tension to prevent ink residue on the wiper from being deposited in a location that will impair or degrade a desired print quality.

43 Claims, 7 Drawing Sheets

Wiper Assembly

Printbar Assembly

Position C

PRINTING MECHANISM MULTI-DIRECTIONAL WIPING TECHNIQUE

TECHNICAL FIELD

This invention relates to printing mechanisms and, in particular, to wiping printheads of an inkjet printing mechanism to clean residual ink and contaminants off of the printheads.

BACKGROUND

An inkjet printer includes a printing assembly having a printhead, or printheads, to deposit ink onto a print media, such as paper. A printhead has an orifice plate that is formed with nozzles through which ink drops are "fired", or otherwise ejected, onto the print media to form an image, such as text or a picture. The ink drops dry, or are heated to dry, on the print media shortly after deposition to form the printed image.

There are various types of inkjet printheads including, for example, thermal inkjet printheads and piezoelectric inkjet printheads. For a thermal inkjet printhead, ink droplets are ejected from individual nozzles by localized heating with a heating element located at individual nozzles. An electric current is applied to a heating element to heat it up which causes a small volume of ink to be rapidly heated and vaporized. Once vaporized, the ink is ejected through the nozzle. A driver circuit is coupled to individual heating elements to provide the energy pulses and thereby controllably deposit ink drops from associated individual nozzles. The drivers are responsive to character generators and other image forming circuitry to energize selected nozzles of a printhead for forming images on the print media.

During printing, ink tends to build up at the nozzle orifices of a printhead. This build-up of residual ink can be caused by ink droplets that are not completely ejected from a nozzle, excess ink at the orifice that is not fully vaporized, or ink spatterings that reflect from the print media when the ink is ejected. The small nozzle orifices of a printhead are also susceptible to clogging by quick drying ink, dust particles and paper fibers, and from solids within the ink. Partially or completely blocked nozzles can result in either missing or misdirected ink drops being deposited onto the print media, either of which impairs printing and degrades the print quality.

The printing assembly typically includes a service station having wipers to clean and preserve the functionality of the printheads. The service station includes a wiper, or wipers, for wiping a printhead to remove ink residue and other contaminants that have been deposited or collected on the printhead surface and over the nozzle openings in the printhead surface. A service station can also include a cap, or capping mechanism, which covers a printhead when the printer is not printing to prevent the ink in the nozzles from drying, and to prevent contaminants from collecting in and over the nozzles.

Although a service station provides wipers, or a wiper system, that substantially cleans and removes residual ink and contaminants from printheads, conventional wiping techniques can cause the residual ink and contaminants removed from a printhead to be "flicked" or otherwise splattered and deposited in an undesirable location that will impair or degrade printing. For example, when a wiper travels across a printhead to remove the residual ink, the wiper is under tension to maintain contact with the printhead and effectively clean the printhead. When the wiper reaches an end of the printhead, the wiper travels off or past the printhead, which causes the wiper contact tension with the printhead to be released. Releasing the tension on the wiper causes any collected residual ink and contaminants to be flicked off of the wiper which can be deposited in undesirable locations, such as on the print media, or on an adjacent printhead.

Accordingly, there is an ever-present need to provide a wiping technique that effectively cleans a printhead while preventing residual ink and contaminants removed from the printhead being deposited in locations that will impair or degrade a desired print quality.

SUMMARY

A print unit, such as an inkjet printing mechanism, includes a print module having one or more printheads to deposit an imaging medium, such as ink, on a print media. The print unit also includes a wiper assembly having one or more wipers that correspond to the one or more printheads, such that when the wiper assembly and the print module are positioned in proximity to service the printheads, the wipers clean the printheads of ink residue and contaminants.

A wiper cleans, or wipes, a printhead when the wiper and the printhead are in contact and when the wiper and/or the printhead is moved relative to the other in a first direction. For example, the wiper can move in a direction that is parallel to a longitudinal axis of the printhead, or the printhead can move in the parallel direction relative to the wiper. A contact tension between the wiper and the printhead holds, or otherwise seats the wiper against the printhead to facilitate cleaning the printhead.

The wiper and the printhead also move relative to each other in at least a second direction to release the contact tension between the wiper and the printhead. For example, the wiper can move in a perpendicular direction relative to the printhead, or the printhead can move in the perpendicular direction relative to the wiper. When the wiper and/or the printhead move in both the first direction and the second direction, the wiper for example, moves along an arc path defined by the first and second directions such that the wiper is moved down and away from the printhead. The wiper is moved along the arc path to controllably release the wiper contact tension and prevent ink residue on the wiper from being flicked, or otherwise deposited in a location that will impair or degrade a desired print quality.

BRIEF DESCRIPTION OF THE DRAWINGS

The same numbers are used throughout the drawings to reference like features and components.

DETAILED DESCRIPTION

Introduction

The following describes systems and methods for a multi-directional wiping technique that cleans residual ink and contaminants from a print unit printhead while keeping the unwanted residual ink and contaminants from being deposited in locations that will impair or degrade a desired print quality. The wiping technique described herein can be implemented in many different printing devices, to include inkjet printing devices.

Exemplary Printing Device Architecture

Figure 1:
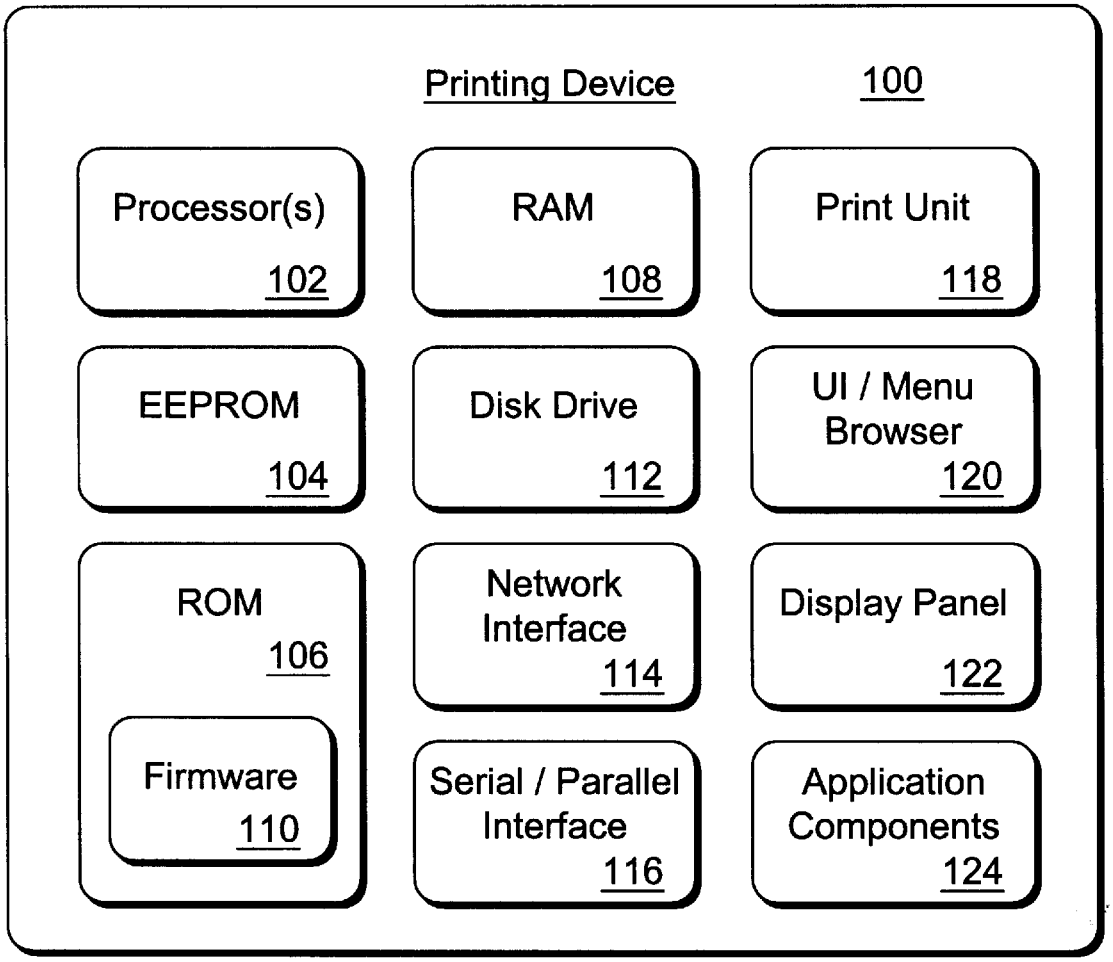
FIG. 1 is block diagram that illustrates various components of an exemplary printing device.

FIG. 1 illustrates various components of an exemplary printing device 100 that can be utilized to implement the inventive techniques described herein. Printer 100 includes one or more processors 102, an electrically erasable programmable read-only memory (EEPROM) 104, ROM 106 (non-erasable), and a random access memory (RAM) 108. Although printer 100 is illustrated having an EEPROM 104 and ROM 106, a particular printer may only include one of the memory components. Additionally, although not shown, a system bus typically connects the various components within the printing device 100.

The printer 100 also has a firmware component 110 that is implemented as a permanent memory module stored on ROM 106. The firmware 110 is programmed and tested like software, and is distributed with the printer 100. The firmware 110 can be implemented to coordinate operations of the hardware within printer 100 and contains programming constructs used to perform such operations.

Processor(s) 102 process various instructions to control the operation of the printer 100 and to communicate with other electronic and computing devices. The memory components, EEPROM 104, ROM 106, and RAM 108, store various information and/or data such as configuration information, fonts, templates, data being printed, and menu structure information. Although not shown, a particular printer can also include a flash memory device in place of or in addition to EEPROM 104 and ROM 106.

Printer 100 also includes a disk drive 112, a network interface 114, and a serial/parallel interface 116. Disk drive 112 provides additional storage for data being printed or other information maintained by the printer 100. Although printer 100 is illustrated having both RAM 108 and a disk drive 112, a particular printer may include either RAM 108 or disk drive 112, depending on the storage needs of the printer. For example, an inexpensive printer may include a small amount of RAM 108 and no disk drive 112, thereby reducing the manufacturing cost of the printer.

Network interface 114 provides a connection between printer 100 and a data communication network. The network interface 114 allows devices coupled to a common data communication network to send print jobs, menu data, and other information to printer 100 via the network. Similarly, serial/parallel interface 116 provides a data communication path directly between printer 100 and another electronic or computing device. Although printer 100 is illustrated having a network interface 114 and serial/parallel interface 116, a particular printer may only include one interface component.

Printer 100 also includes a print unit 118 that includes mechanisms arranged to selectively apply an imaging medium such as liquid ink, toner, and the like to a print media in accordance with print data corresponding to a print job. Print media can include any form of media used for printing such as paper, plastic, fabric, Mylar, transparencies, and the like, and different sizes such as 8½×11, A4, etc. For example, print unit 118 can include an inkjet printing mechanism that selectively causes ink to be applied to a print media in a controlled fashion. The ink on the print media can then be more permanently fixed to the print media, for example, by selectively applying conductive or radiant thermal energy to the ink. Those skilled in the art will recognize that there are many different types of print units available, and that for the purposes of the present invention, print unit 118 can include any of these different types.

Printer 100 also includes a user interface and menu browser 120, and a display panel 122. The user interface and menu browser 120 allows a user of the printer 100 to navigate the printer's menu structure. User interface 120 can be indicators or a series of buttons, switches, or other selectable controls that are manipulated by a user of the printer. Display panel 122 is a graphical display that provides information regarding the status of the printer 100 and the current options available to a user through the menu structure.

Printer 100 can, and typically does include application components 124 that provide a runtime environment in which software applications or applets can run or execute. Those skilled in the art will recognize that there are many different types of runtime environments available. A runtime environment facilitates the extensibility of printer 100 by allowing various interfaces to be defined that, in turn, allow the application components 124 to interact with the printer.

General reference is made herein to one or more printing devices, such as printing device 100. As used herein, "printing device" means any electronic device having data communications, data storage capabilities, and/or functions to render printed characters and images on a print media. A printing device can be a printer, fax machine, copier, plotter, and the like. The term "printer" includes any type of printing device using a transferred imaging medium, such as ejected ink, to create an image on a print media, and using a wiper assembly to clean imaging medium residue from an imaging medium applicator. Examples of such a printer can include, but are not limited to, inkjet printers, dry medium printers, copiers, facsimile machines, plotters, portable printing devices, cameras, and video printers, as well as multi-function devices such as a combination facsimile/printer or facsimile/scanner. Although specific examples may refer to one or more of these printers, such examples are not meant to limit the scope of the claims or the description, but are meant to provide a specific understanding of the described implementations.

Exemplary Printing Devices

Figure 2:
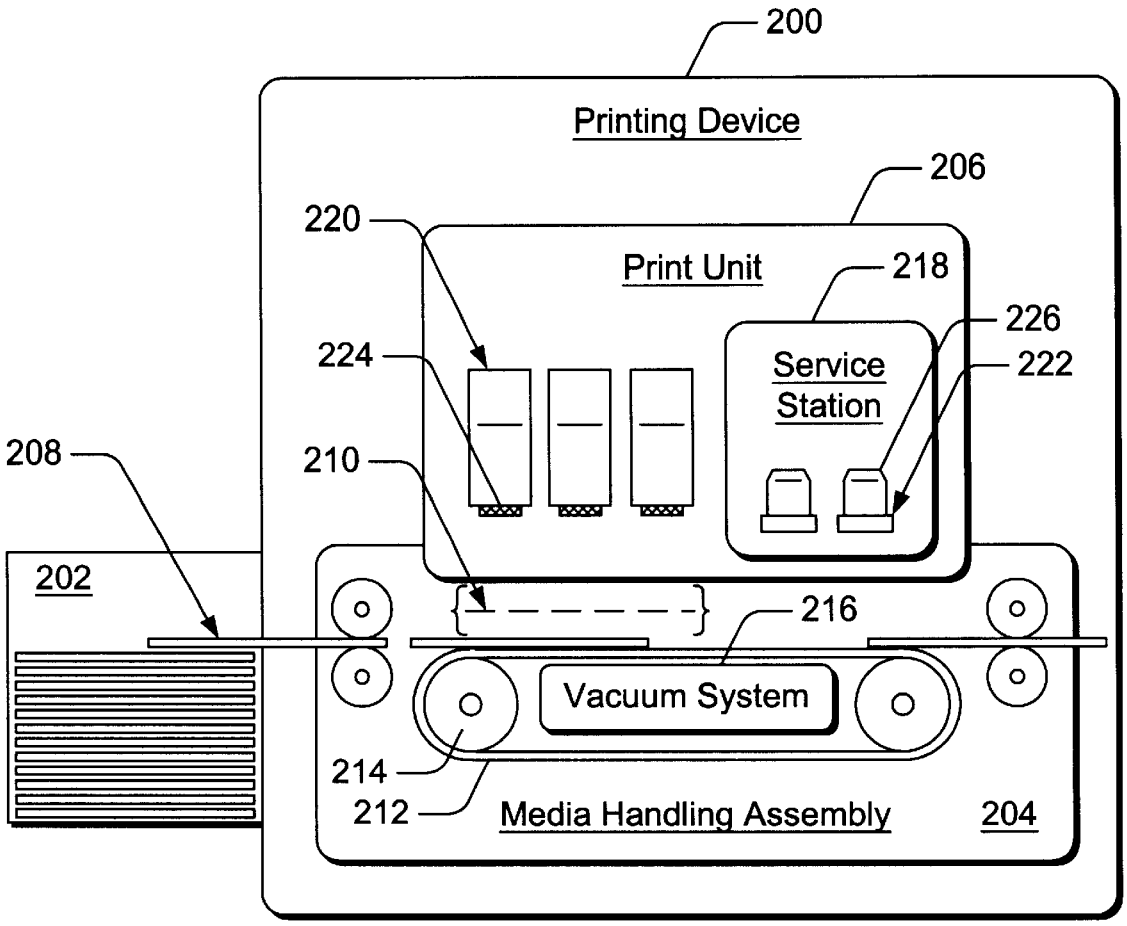
FIG. 2 is an illustration of various components of an exemplary printing device.

FIG. 2 illustrates a printing device 200 that can include one or more of the components of the exemplary printing device 100 (FIG. 1). The multidirectional wiping technique is described in the environment and context of an inkjet printing device. While it is apparent that printing device components vary from one device to the next, those skilled in the art will recognize the applicability of the present invention to printing devices in general.

Printing device 200 includes a print media container 202, a media handling assembly 204, and a print unit 206. The print media container 202 holds print media 208 until the media handling assembly 204 takes up a print media and routes it through the printing device 200 for printing. The physical path of the print media through a printer is typically referred to as the "print path" or "print media path". When the print media 208 is routed within printing device 200 by the media handling assembly 204, the print media passes through, or within a proximity, of a print zone 210 in the printing device. At print zone 210, the print media 208 is deposited with an imaging medium, such as ink, from the print unit 206 in response to the printing device 200 receiving print data corresponding to a print job.

The media handling assembly 204 includes components to route print media 208 through the printing device 200. The media handling assembly components include a media routing belt 212 that is positioned to route the print media 208 through the print zone 210. The media routing belt 212 can be formed of a metal material, or other material that withstands the structural demands imposed by the printing process, to include localized heat that is generated to permanently fix an imaging medium, such as ink, to a print media.

The media routing belt 212 is driven by a belt drive and/or pulley and roller system 214 which is coupled to a motor drive unit (not shown). Those skilled in the art will recognize that there are any number of media handling assembly configurations that can be implemented in any number of printing devices to route print media through a printing device.

The media handling assembly also includes a vacuum system 216 to hold a print media 208 on the media routing belt 212 while the print media 208 is routed through the printing device 200. The media routing belt 212 can be perforated, or otherwise facilitate air flow through it, such that the vacuum system 216 located underneath the belt can hold the print media 208 on top of the belt while the print media is routed through the print zone 210.

Figure 3:
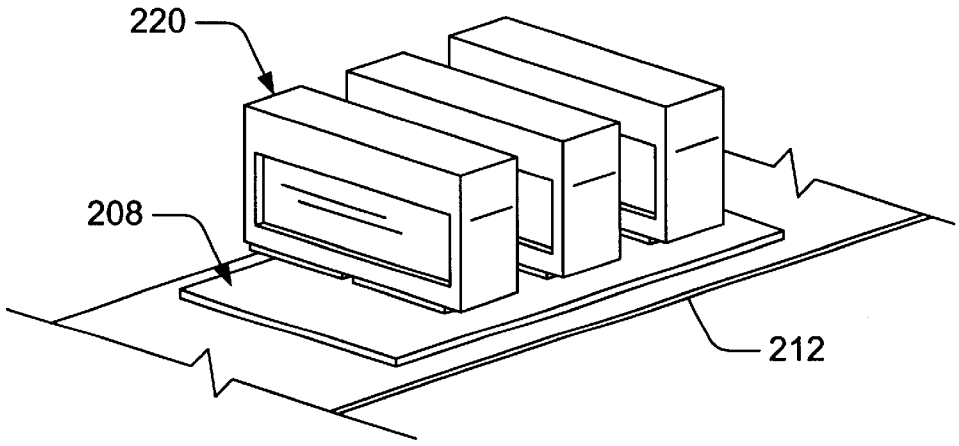
FIG. 3 is an illustration of printbar assemblies positioned for printing a print media.

Print unit 206 includes a service station 218 and a printbar assembly 220. The print unit 206 can have one or more printbar assemblies to deposit an imaging medium on a print media 208 within the print zone 210. Printbar assembly 220 is illustrated from an end-view, and spans the width of a print media 208 as the print media is routed in printing device 200. FIG. 3 illustrates a configuration of more than one printbar assembly 220 positioned for printing over a print media 208 that is routed in printing device 200 via the media routing belt 212.

The service station 218 includes a wiper assembly 222 that is mounted on and/or integrated with service station 218 to clean nozzle sections of printheads 224 on the printbar assembly 220. A wiper assembly 222 has wipers 226 to clean the printheads 224 and remove ink residue and contaminants to maintain a desired printing quality.

The printheads 224 are cleaned periodically during operation of printing device 200. A processor, or processors, in printing device 200 schedules routine servicing of the printheads based upon the printing time, the number of ink drops being ejected, and/or other printing related factors. For example, the printheads can be cleaned after an approximate time duration, such as after every ten minutes of printing time, or the printheads can be cleaned after a number of print media pages are printed, such as after every one-hundred pages. The service station 218 can have multiple wiper assemblies corresponding to multiple printbar assemblies in print unit 206.

As an alternative to printing device 200 having a print unit 206 with a fixed printbar assembly 220, printing device 200 can be an inkjet printer having a print unit 206 that includes a reciprocating inkjet pen carriage system for travel back and forth across a print zone along an axis that spans a print media, or otherwise spans a printing width. An example of an inkjet printer having a reciprocating print unit is described in U.S. Pat. No. 5,774,140. The described implementations of a multi-directional wiping technique are applicable to any number of printing mechanisms having one or multiple printheads.

Exemplary Printbar Assembly

Figure 4:
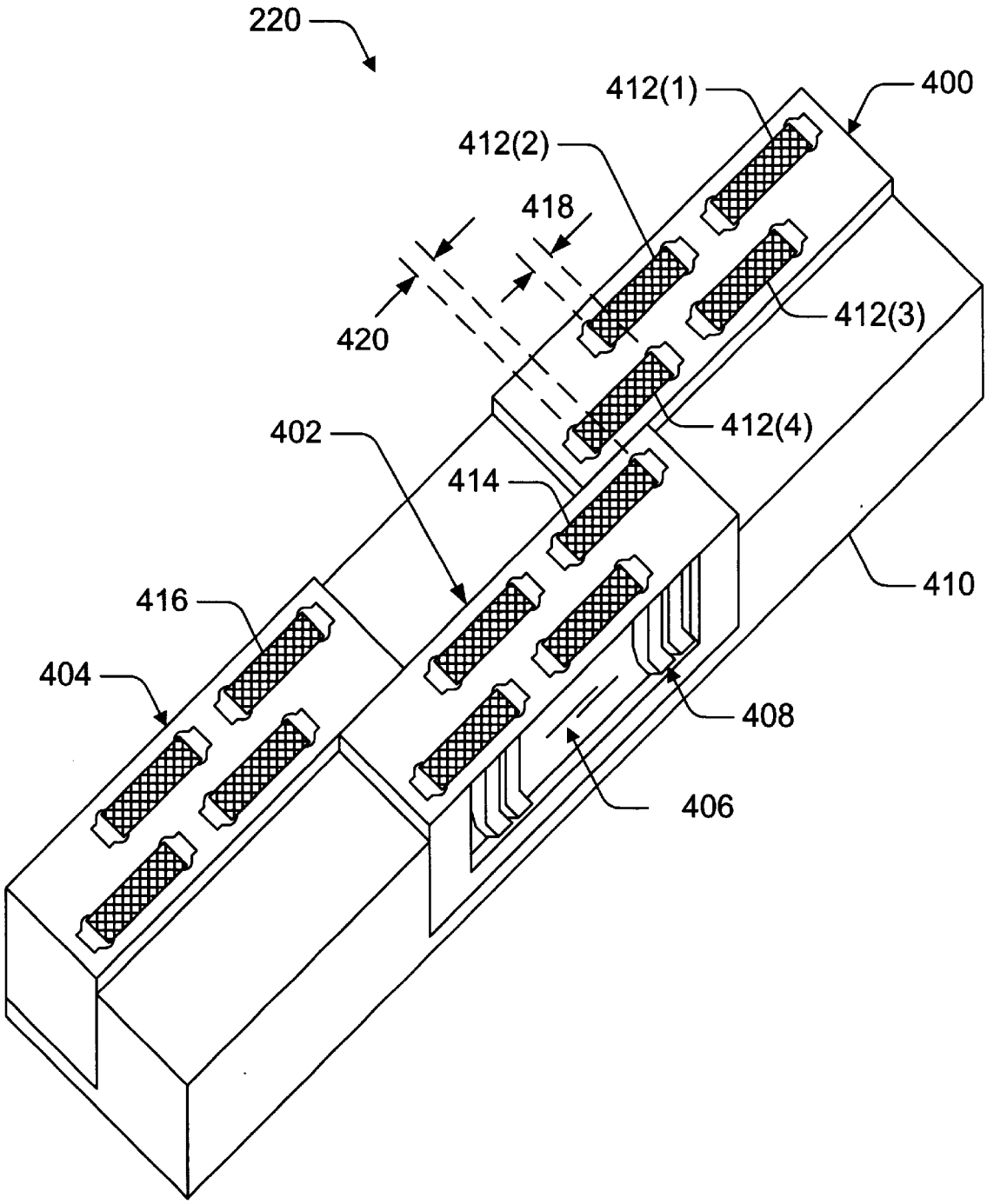
FIG. 4 is an illustration of an exemplary printbar assembly having print modules and multiple printheads.

FIG. 4 illustrates components of a printbar assembly 220. The printbar assembly 220 is shown having three print modules 400, 402, and 404, although any number of print modules can be combined in a printbar assembly to span the width of a print media, or span a printing width. A print module is also commonly referred to as a "cartridge", or a "pen". Conventionally, a print module includes an ink reservoir 406 to store a supply of ink and electrical connectors 408 to receive printing control signals from one or more printing device processors.

The printbar assembly 220 has a framework 410 to support and align the print modules, and to install the printbar assembly in a printing device. Those skilled in the art will recognize that any number of varying framework configurations can be implemented to support the print modules, and the printbar assembly in a printing device.

A print module, such as print module 400, has any number of printheads 412, each having multiple nozzles that eject ink onto a print media to form an image. Print module 402 has multiple printheads such as printhead 414, and print module 404 has multiple printheads such as printhead 416. A printhead is also commonly referred to as a "die".

Collectively, the printheads on print bar assembly 220 span a printing width, or a print media width, and overlap to effectively deposit, or transfer, an imaging medium across the printing width without gaps in the imaging medium. The printheads on an individual print module overlap, and the printheads on adjacent print modules overlap. For example printheads 412(2) and 412(4) on print module 400 have an overlap 418, and printhead 412(4) on print module 400 has an overlap 420 with printhead 414 on print module 402.

Exemplary Wiper Assembly

Figure 5:
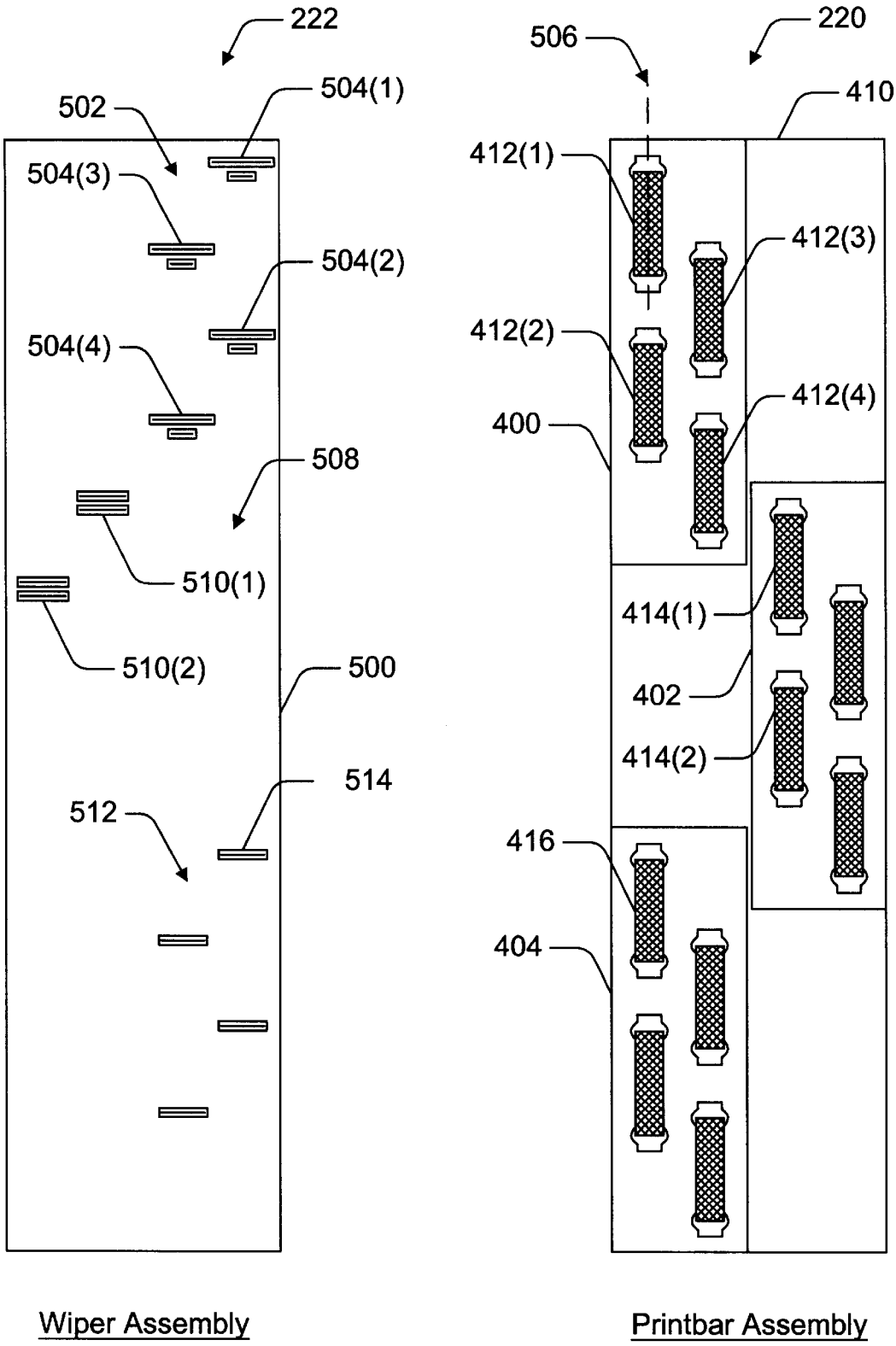
FIG. 5 is an illustration of a wiper assembly having various wiper configurations that correspond to printheads on a printbar assembly.

FIG. 5 illustrates components of a wiper assembly 222. The wiper assembly is shown adjacent the printbar assembly 220 that is also illustrated in FIG. 4. FIG. 5 illustrates an exemplary alignment and configuration of wiper components on the wiper assembly 222 with corresponding printheads on the printbar assembly 220.

The wiper assembly 222 has a framework 500 to support the wiper components, and to install the wiper assembly in a printing device. Those skilled in the art will recognize that any number of varying framework configurations can be implemented to support the wiper components, and the wiper assembly in a printing device. The wiper assembly 222 can also include a drive mechanism (not shown) that facilitates the wiper assembly being positioned in proximity to a print bar assembly 220 such that wiper components on the wiper assembly 222 can contact and clean corresponding printheads on the printbar assembly 220. The drive mechanism can comprise any conventional drive coupling device that is mechanically coupled to and powered by a separate power source, such as a motor.

The wiper assembly 222 is shown having varying wiper component configurations in different regions of the wiper assembly, although it should be recognized that in practice, the wiper components would be standardized on the wiper assembly. In a first region 502 of the wiper assembly 222, wipers 504 are illustrated in a configuration having two wipers, one having a width corresponding to one-half the width of a print module 400, and the other wiper having a width corresponding to the width of a printhead 412.

The wipers in region 502 correspond to the printheads 412 on print module 400. For example, wipers 504(1) correspond to printhead 412(1) (when the printbar assembly is "flipped" over and positioned above the wiper assembly, or vice-versa). When wipers 504(1) are positioned to contact printhead 412(1), the wipers are moved across the printhead in a direction that is parallel to a longitudinal axis 506 of printhead 412(1) to remove any ink residue and other contaminants from the printhead. It should be recognized that the movement between the wipers and the printhead is relative, and that the printhead can be moved across the wipers in a parallel direction relative to the wipers to clean the printhead. For example, for bi-directional wiping, the wipers 504(1) can be moved in a first direction that is parallel to a longitudinal axis 506 of printhead 412(1), and in a second direction that is opposite to the first direction, to clean printhead 412(1).

In region 502 of the wiper assembly 222, individual wipers 504 correspond to each of the printheads 412 on print module 400. That is, wipers 504(1) clean printhead 412(1), wipers 504(2) clean printhead 412(2), wipers 504(3) clean printhead 412(3), and wipers 504(4) clean printhead 412(4) when the wipers contact the printheads and move in a relative direction that is parallel to a longitudinal axis of the printheads.

In a region 508 of the wiper assembly 222, wipers are illustrated in a configuration having two wipers that both correspond to one-half the width of a print module, such that the printheads and the entire width of the print module is cleaned when wiped with the wipers. The wipers 510 in region 508 correspond to the printheads 414 on print module 402, however each set of wipers 510 correspond to two of the printheads 414 that are aligned on print module 402. For example, wipers 510(1) clean printhead 414(1) and printhead 414(2) when the wipers contact the printheads and move in a relative direction that is parallel to a longitudinal axis of the printheads.

In a region 512 of the wiper assembly 222, wipers are illustrated in a configuration having only one wiper that corresponds to one-half the width of a print module, such that the printheads and the entire width of the print module is cleaned when wiped with the wipers. The wipers in region 512 correspond to the printheads 416 on print module 404, and an individual wiper 514 corresponds to one printhead 416 on print module 404.

Figure 6:
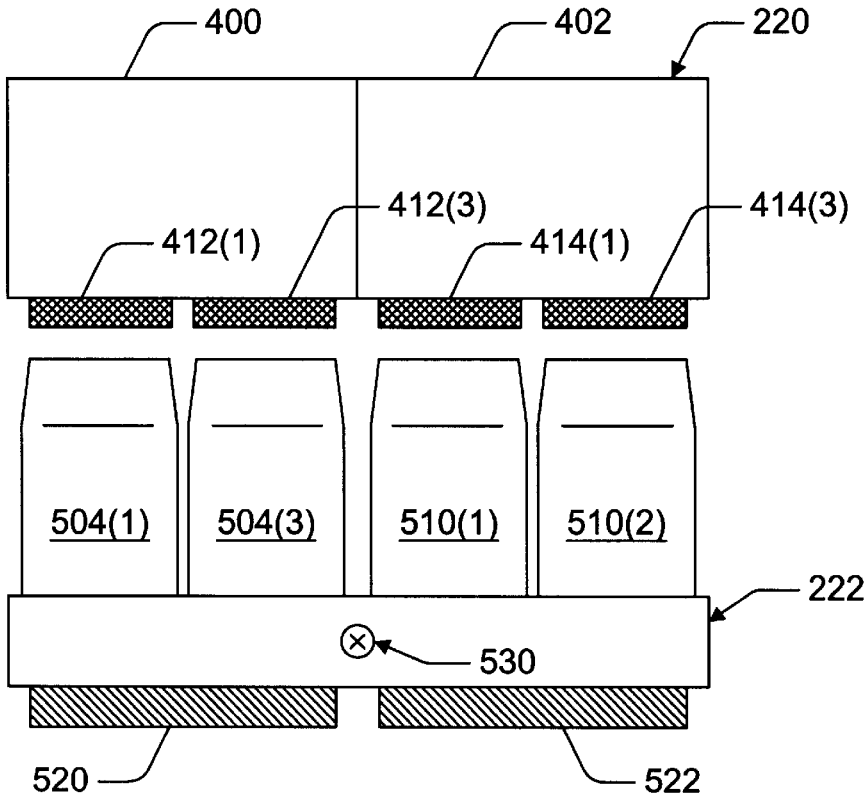
FIG. 6 is an illustration of a wiper assembly and wipers that correspond to printheads on a printbar assembly.

FIG. 6 illustrates an end-view of the printbar assembly 220 and the wiper assembly 222 positioned one over the other in proximity such that the wipers on wiper assembly 222 contact corresponding printheads on printbar assembly 220. For example, wipers 504(1) and 504(3) are positioned to contact and clean printheads 412(1) and 412(3) on print module 400, respectively. Additionally, wipers 510(1) and 510(2) are positioned and aligned to contact and clean printheads 414(1) and 414(3) on print module 402, respectively.

FIG. 6 also illustrates the wiper assembly 222 having caps 520 and 522 to cover printheads 414 on print module 402 and printheads 412 on print module 400, respectively. The caps 520 and 522 prevent ink in the nozzles of the printheads from drying when the printer is sitting idle, and prevent contaminants from collecting in the nozzles and on the printheads.

To position the caps 520 and 522 in proximity to the printheads for the purpose of engaging the printheads and the caps, the wiper assembly 222 is designed to rotate about an axis 530. When wiper assembly 222 is rotated about axis 530, and the caps are positioned to engage the printheads, either the wiper assembly 222 and/or the printbar assembly 220 can be moved in relation to each other to engage and cover the printheads with the caps.

Exemplary Wiper Configurations

Figure 7:
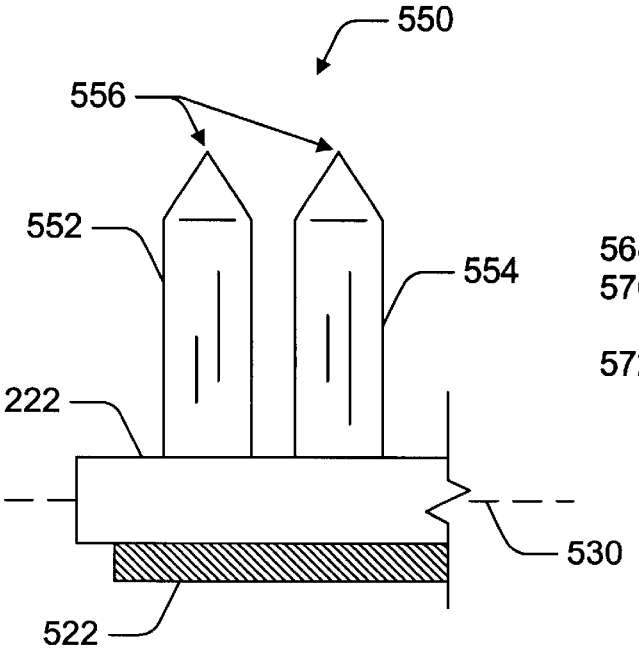
FIG. 7 is an illustration of a wiper assembly having a wiper configuration that includes two wipers.

FIG. 7 illustrates a section of a wiper assembly 222 having a wiper configuration 550 that includes two wipers 552 and 554, although any number of wipers can be configured together to clean a corresponding printhead. FIG. 7 also illustrates a side-view section of cap 522 and longitudinal axis 530, as described above in reference to FIG. 6. The wipers 552 and 554 can be configured such as wipers 504 (FIG. 5), for example, where one wiper 552 corresponds to one-half the width of a print module 400, and the other wiper 554 has a width corresponding to the width of a printhead. Alternatively, the wipers can be configured such as wipers 510 (FIG. 5), where both wipers 552 and 554 are the same width and span at least the width of a printhead.

Each of the wipers 552 and 554 have an elongated blade 556 that engages and wipes associated printhead nozzle sections to remove ink residue and build-up. The blade 556 of a wiper has sufficient width to wipe a cleaning path over all of the printhead nozzles in one pass across the printhead.

The wipers 552 and 554 can be formed of a resilient, non-abrasive, elastomeric material, such as nitrile rubber, ethylene polypropylene diene monomer (EPDM), or other comparable materials. Those skilled in the art will recognize that the wipers can be made with any number of varying materials, and combinations of materials.

Figure 8:
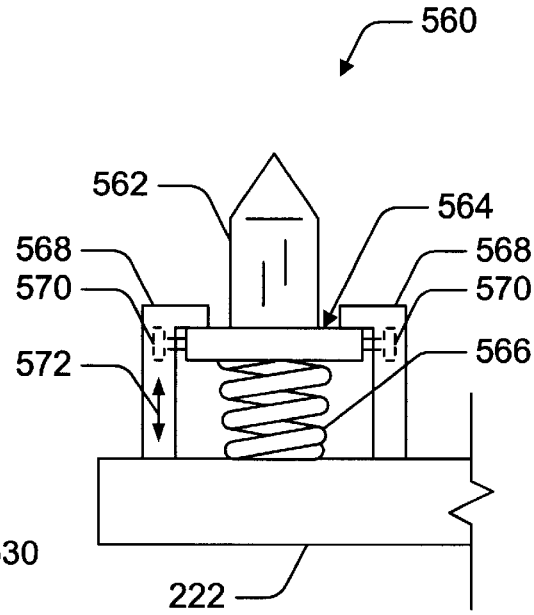
FIG. 8 is an illustration of a wiper assembly having a wiper configuration that includes a spring to apply pressure and hold a wiper in contact with a printhead.

FIG. 8 illustrates a section of a wiper assembly 222 having a wiper configuration 560 that includes a wiper 562 and a spring assembly 564. The configuration 560 can also include any number of wipers positioned together to clean a corresponding printhead, such as two wipers together as shown in configuration 550 (FIG. 7). The spring assembly 564 includes a spring 566 that applies a pressure, or force, to hold the wiper 562 in contact with a printhead while cleaning the printhead. The spring assembly 564 also includes guideposts 568 and slidable members 570 to align travel of the spring assembly in directions indicated by arrows 572.

Additionally, spring assembly 564 compensates for variations in spacing between the wiper assembly 222 and a corresponding printbar assembly that can be caused in part by manufacturing tolerances. Any spacing variations between a wiper assembly and a printbar assembly translate to spacing variations between a wiper and a printhead which can impair the cleaning effectiveness of the wiper due to inadequate contact with the printhead.

Exemplary Printhead Multi-Directional Wiping Technique

Figure 9:
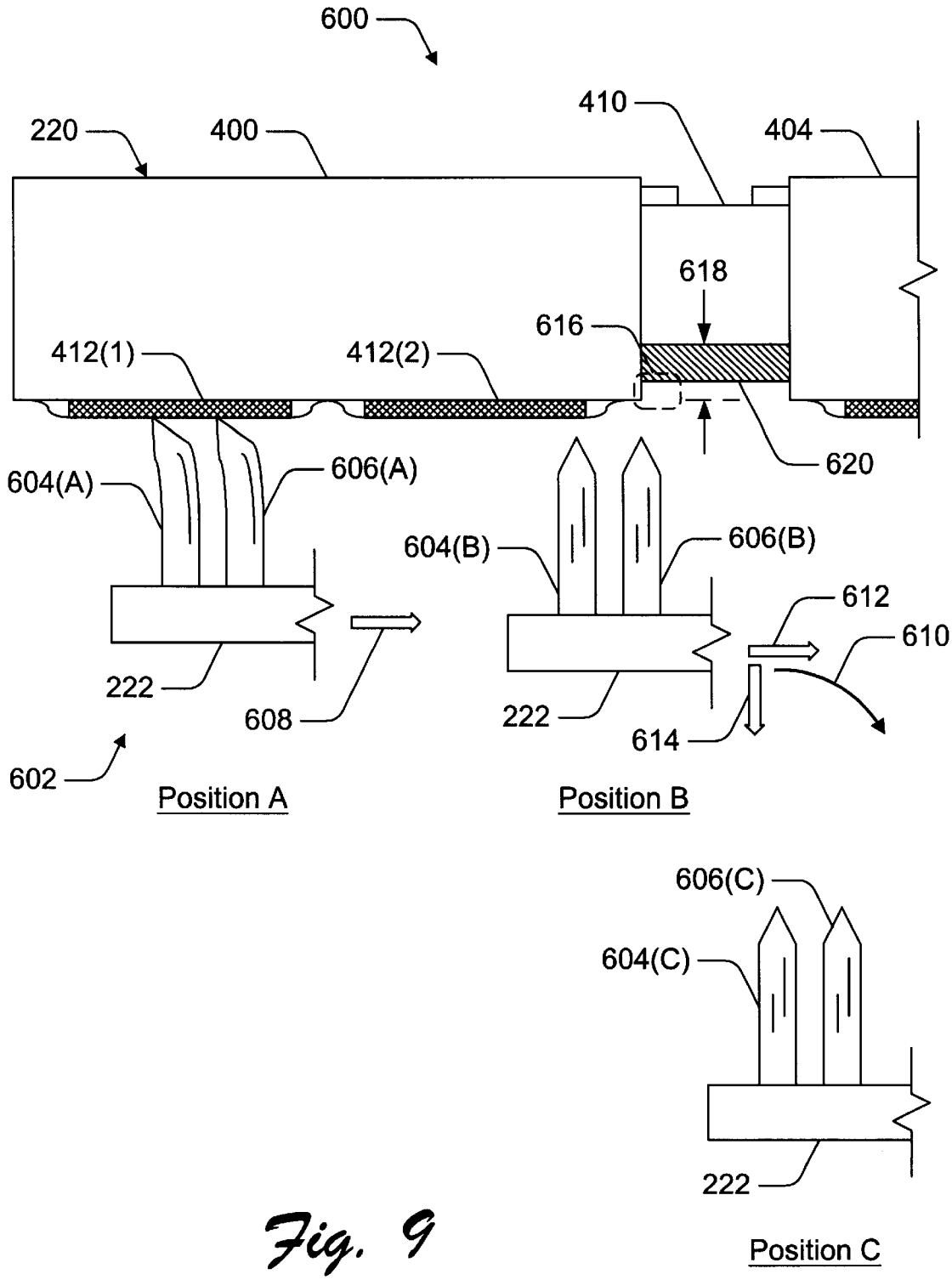
FIG. 9 is an illustration of an exemplary wiping technique with a wiper assembly having a wiper configuration that includes two wipers.

FIG. 9 illustrates a wiping technique 600 that cleans residual ink and contaminants from a print unit printhead while preventing the unwanted residual ink and contaminants from being deposited in locations that will impair or degrade a desired print quality. A wiper configuration 602 illustrates a section of wiper assembly 222 and includes two wipers 604(A) and 606(A) at a first Position A. (The wipers 604 and 606 are illustrated in Positions A, B, and C in FIG. 9, and are designated with a corresponding position identifier, such as wiper 604(A) in Position A).

The wipers 604(A) and 606(A) contact printhead 412(1) on print module 400, and move relative to the printhead in a direction that is parallel to a longitudinal axis of the printhead as indicated by arrow 608 to clean the printhead. When the wipers are in contact with the printhead, the wipers are under tension and bend while the wipers move relative to the printhead. The tension enhances the cleaning of the printhead by maintaining wiper contact with the printhead.

At a second Position B, the wipers 604(B) and 606(B) contact printhead 412(2) and move relative to the printhead in the same parallel direction indicated by arrow 608 to clean the printhead. When wiper 606(B) reaches an end of the printhead 412(2), the wipers move in a direction that is an arc path indicated by arrow 610. The arc path 610 is defined by the wipers moving in both a parallel direction relative to the printhead indicated by arrow 612 and a perpendicular direction relative to the printhead indicated by arrow 614. Although arc path 610 is described as being defined by two directions 612 and 614, it is apparent that an arc path can be defined by any number of directions.

Moving the wipers 604(B) and 606(B) down and away from printhead 412(2) along the arc path 610 prevents any ink residue and contaminants that are on the wipers from being "flicked" or otherwise splattered and deposited in an undesirable location that will impair or degrade printing. For example, if wiper 606(B) was not moved along arc path 610, but rather moved parallel across printhead 412(2) in the direction indicated by arrow 612, and the wiper traveled off or past the printhead and the print module into area 616, the wiper contact tension would be suddenly released causing any ink residue and contaminants on the wiper to be flicked off. The ink residue and contaminants could be deposited in such undesirable locations as on an adjacent printhead, such as on print module 404, somewhere on the printbar assembly framework 410, such as in a gap 618 between print modules, or on the print media.

Position B shows that the wipers can be moved along arc path 610 to controllably release the contact tension of the wipers relative to the printhead, and preferably just as the wipers reach the end of printhead 412(2) and print module 400 to avoid flicking any collected ink residue or contaminants.

At a third Position C, the wipers 604(C) and 606(C) are shown separated from, or otherwise not in contact with, a printhead. For bi-directional wiping, the wipers 604 and 606 can be moved from Position C and back into contact with a printhead, such as printhead 412(2). The wipers can then be moved relative to the printhead in a direction opposite to the direction indicated by arrow 608 to clean the printhead, or printheads. When the wipers reach the end of printhead 412(1), the wipers are again moved in a direction that is an arc path down and away from the printhead to avoid flicking any collected ink residue or contaminants.

FIG. 9 further illustrates that an absorbent material 620 can be affixed to the printbar assembly 220, or to a print module, to absorb, or contain, any ink residue that does come off of a wiper. The absorbent material 620 is shown positioned in the gap 618 between print modules 400 and 404 on the printbar assembly frame 410 where ink residue would be likely to accumulate.

Methods for a Multi-Directional Wiping Technique

Figure 10:
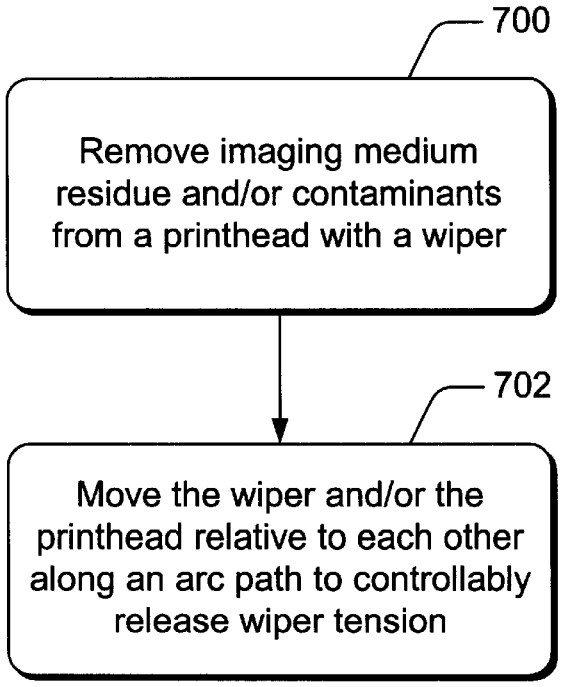
FIG. 10 is a flow diagram that describes a method for removing an imaging medium residue from a printhead with a multi-directional wiping technique.

FIG. 10 illustrates a method for a multi-directional wiping technique. The order in which the method is described is not intended to be construed as a limitation. Furthermore, the method can be implemented in any suitable hardware, software, firmware, or combination thereof. In addition, the method can be implemented by one or more processors executing instructions that are maintained on a computer-readable media.

At block 700, a wiper removes imaging medium residue and/or other contaminants from a printhead. The wiper removes the imaging medium residue when the wiper and the printhead are in contact and when the wiper and/or the printhead is moved relative to the other in a first direction. For example, the wiper can move in a direction that is parallel to a longitudinal axis of the printhead, or the printhead can move in the parallel direction relative to the wiper.

At block 702, the wiper and the printhead are separated by moving the wiper and/or the printhead relative to the other along an arc path defined by the parallel direction and a perpendicular direction. Effectively, the wiper moves down and away from the printhead to release the contact tension between the wiper and the printhead. The tension on the wiper is released in a controlled manner to avoid flicking the imaging medium residue and having it deposited in an undesirable location. Alternatively, the printhead can be moved up and away from the wiper along the arc path.

Figure 11:
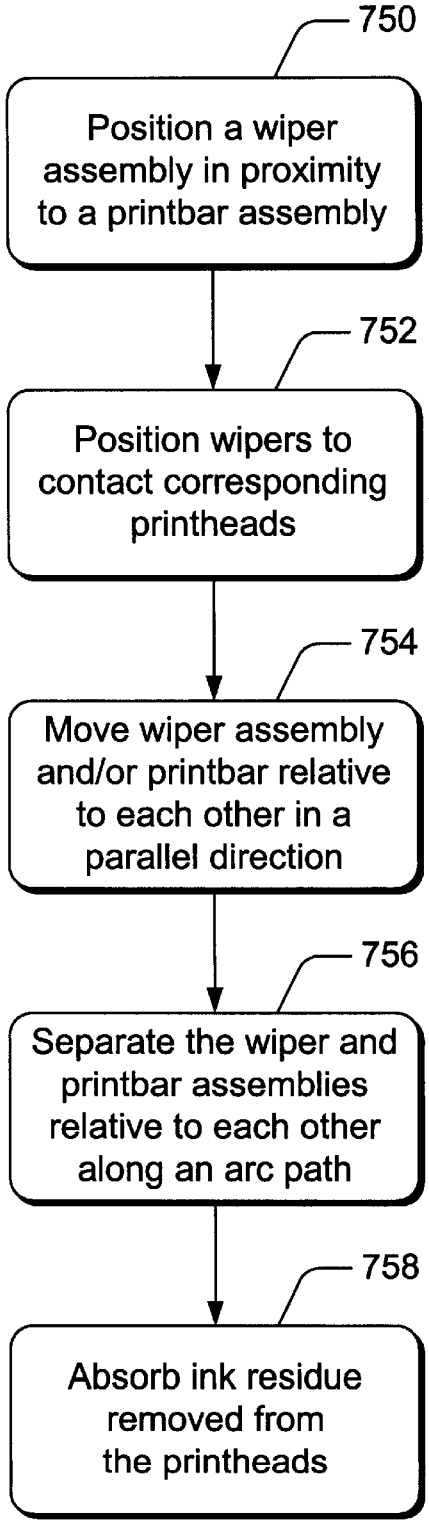
FIG. 11 is a flow diagram that describes a method for a print unit multidirectional wiping technique.

FIG. 11 illustrates a method for a print unit multi-directional wiping technique. The order in which the method is described is not intended to be construed as a limitation. Furthermore, the method can be implemented in any suitable hardware, software, firmware, or combination thereof. In addition, the method can be implemented by one or more processors executing instructions that are maintained on a computer-readable media.

At block 750, a wiper assembly is positioned in proximity to a printbar assembly. When the wiper assembly is positioned, wipers on the wiper assembly are aligned with corresponding printheads on the printbar assembly. Alternatively, the printbar assembly can be positioned to align the printheads with corresponding wipers on the wiper assembly.

At block 752, the wipers are positioned to contact the printheads. Each printhead can have one or more corresponding wipers positioned to remove ink residue and contaminants from a printhead. The wipers can be positioned to contact the printheads by applying a pressure, or force, to create a contact tension between the wipers and the printheads. The force can be provided with a spring assembly, for example, or with a combination wiper and spring assembly. Additionally, the force can be provided by the wiper assembly via a coupled drive assembly that positions the wiper assembly in a printing device.

At block 754, the wiper assembly and/or the printbar assembly is moved relative to the other and in a direction that is parallel to a longitudinal axis of the printbar such that the wipers remove ink residue and contaminants from the printheads. The wiper assembly can be moved in the parallel direction relative to the printbar assembly, or alternatively, the printbar assembly can be moved in the parallel direction relative to the wiper assembly.

At block 756, the wiper assembly and the printbar assembly are separated to release the contact tension between the wipers and the printheads such that the wipers no longer contact the printheads. The wiper assembly and the printbar assembly are separated by moving at least one of the wiper assembly and the printbar assembly relative to the other along an arc path defined by the parallel direction and at least one other direction, such as in a perpendicular direction. Effectively, the wipers are moved down and away from the printheads.

To separate the wiper assembly and the printbar assembly, the wiper assembly can be moved along the arc path such that the wiper assembly moves both parallel and perpendicular relative to the printbar assembly. Alternatively, the printbar assembly can be moved along the arc path such that the printbar assembly moves both parallel and perpendicular relative to the wiper assembly.

Separating the wiper assembly and the printbar assembly can involve relieving a pressure, or force, to release the contact tension between the wipers and the printheads. Relieving the pressure moves at least one of the wiper assembly and the printbar assembly relative to the other in the perpendicular direction.

At block 758, an absorbent material absorbs any ink residue that is inadvertently deposited from off of the wipers after the wipers remove the ink residue from the printheads. For example, absorbent material 620 (FIG. 9) between print modules 400 and 404 absorbs any ink residue that comes off of a wiper 604 or 606 when the wipers travel off of printhead 412(2) and past the print module 400.

Conclusion

The printing mechanism multi-directional wiping technique cleans residual ink and contaminants from a print unit printhead while controllably releasing wiper contact tension and preventing the residual ink and contaminants from being flicked, or otherwise spattered in locations that will impair or degrade a desired print quality.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A print unit, comprising:

a print module having one or more printheads configured to deposit an imaging medium on a print media;

a wiper assembly having at least one wiper configured to remove imaging medium residue from a printhead when the wiper and the printhead are in contact and when at least one of the wiper and the printhead is moved relative to the other in a direction that is parallel to a longitudinal axis of the printhead; and the wiper is configured to separate from the printhead along an arc path that is defined by the wiper moving in the parallel direction and the wiper moving in a perpendicular direction relative to the printhead.

2. A print unit as recited in claim 1, wherein the print module is configured to move the printhead in the parallel direction such that the wiper removes the imaging medium residue from the printhead.

3. A print unit as recited in claim 1, wherein the wiper assembly is configured to move the wiper in the parallel direction such that the wiper removes the imaging medium residue from the printhead.

4. A print unit as recited in claim 1, wherein the wiper assembly is configured to move the wiper in the parallel direction such that the wiper removes the imaging medium residue from the printhead, and wherein the wiper assembly is further configured to move the wiper in the perpendicular direction to separate the wiper and the printhead.

5. A print unit as recited in claim 1, wherein the wiper assembly is configured to move the wiper along the arc path to release a contact tension between the wiper and the printhead.

6. A print unit as recited in claim 1, wherein the wiper assembly includes a spring assembly configured to apply a pressure to hold the wiper in contact with the printhead.

7. A print unit as recited in claim 1, wherein:

the wiper assembly includes a spring assembly configured to apply a pressure to hold the wiper in contact with the printhead; and the wiper is separated from the printhead when the pressure is released to move the wiper in the perpendicular direction.

8. A print unit as recited in claim 1, wherein:

the wiper assembly includes a spring assembly configured to apply a pressure to hold the wiper in contact with the printhead;

the wiper assembly is configured to move the wiper in the parallel direction such that the wiper removes the imaging medium residue from the printhead; and the wiper is separated from the printhead when the pressure is released to move the wiper in the perpendicular direction.

9. A print unit as recited in claim 1, further comprising an absorbent material affixed to the print unit to absorb the imaging medium residue.

10. A print unit as recited in claim 1, further comprising an absorbent material to absorb imaging medium residue that would otherwise accumulate on the print module.

11. An inkjet printing mechanism, comprising:

at least one printbar assembly;

one or more print modules coupled to the printbar assembly, an individual print module having one or more printheads;

a service station having one or more wiper assemblies, an individual wiper assembly having at least one wiper configured to clean a printhead when the wiper and the printhead are in contact and at least one of the wiper and the printhead is moved relative to the other in a direction that is parallel to a longitudinal axis of the printhead; and the wiper is configured to separate from the printhead along an arc path that is defined by the wiper moving in the parallel direction and the wiper moving in a perpendicular direction relative to the printhead.

12. An inkjet printing mechanism as recited in claim 11, wherein the service station is configured to move the wiper in the parallel direction such that the wiper cleans the printhead.

13. An inkjet printing mechanism as recited in claim 11, wherein the printbar assembly is configured to move the printhead in the parallel direction such that the wiper cleans the printhead.

14. An inkjet printing mechanism as recited in claim 11, wherein the service station is configured to move the wiper in the parallel direction such that the wiper cleans the printhead, and wherein the service station is further configured to move the wiper along the arc path to separate the wiper and the printhead.

15. An inkjet printing mechanism as recited in claim 11, wherein the service station is configured to move the wiper along the arc path to release a contact tension between the wiper and the printhead.

16. An inkjet printing mechanism as recited in claim 11, further comprising an absorbent material affixed to the printbar assembly to absorb ink residue.

17. An inkjet printing mechanism as recited in claim 11, further comprising an absorbent material to absorb ink residue that accumulates between a first and a second of the one or more print modules.

18. A method, comprising:

removing imaging medium residue from a printhead with a wiper by moving at least one of the wiper and the printhead relative to the other in a direction that is parallel to a longitudinal axis of the print head; and separating the wiper from the printhead by moving the wiper along an arc path defined by the parallel direction and moving the wiper in a perpendicular direction relative to the printhead.

19. A method as recited in claim 18, wherein removing comprises moving the wiper in the parallel direction, and wherein separating comprises moving the wiper along the arc path.

20. A method as recited in claim 18, wherein removing comprises moving the printhead in the parallel direction, and wherein separating comprises moving the wiper along the arc path.

21. A method as recited in claim 18, further comprising removing the imaging medium residue from the printhead with at least a second wiper by moving the at least second wiper and the printhead relative to the other in the parallel direction, and wherein the wiper and the second wiper move together.

22. A method as recited in claim 18, further comprising:

removing the imaging medium residue from the printhead with a second wiper by moving the second wiper and the wiper together in the parallel direction; and separating the second wiper and the printhead by moving the second wiper and the wiper together along the arc path defined by the parallel direction and the perpendicular direction.

23. A method as recited in claim 18, further comprising applying a pressure with a spring assembly to hold the wiper in contact with the printhead.

24. A method as recited in claim 18, further comprising applying a pressure with a spring assembly to hold the wiper in contact with the printhead, and wherein separating comprises releasing the pressure to move the wiper along the arc path.

25. A method as recited in claim 18, further comprising releasing a contact tension between the wiper and the printhead.

26. A method as recited in claim 18, further comprising absorbing the imaging medium residue with an absorbent material.

27. A method for cleaning inkjet printheads on a printbar in an inkjet printing device, the method comprising:

positioning a wiper assembly to wipe each of the printheads with at least one wiper;

removing ink residue from a printhead with a wiper by moving the wiper assembly in a direction that is parallel to a longitudinal axis of the printhead; and separating the wiper from the printhead by moving the wiper assembly along an arc path that is defined by at least the wiper assembly moving in the parallel direction and the wiper assembly moving in a perpendicular direction relative to the printbar.

28. A method for cleaning inkjet printheads as recited in claim 27, further comprising releasing a contact tension between the wiper and the printhead.

29. A method for cleaning inkjet printheads as recited in claim 27, wherein positioning comprises applying a pressure with a spring assembly to hold the wiper in contact with the printhead.

30. A method for cleaning inkjet printheads as recited in claim 27, wherein positioning comprises applying a pressure with a spring assembly to hold the wiper in contact with the printhead, and separating comprises releasing the pressure to move the wiper in the perpendicular direction.

31. An inkjet printing mechanism, comprising:

means for maintaining a contact tension between a wiper and a printhead while moving the wiper in a direction that is parallel to a longitudinal axis of the printhead to remove ink residue from the printhead; and means for controllably releasing the contact tension to separate the wiper and the printhead by moving the wiper in a perpendicular direction while moving the wiper in the parallel direction.

32. An inkjet printing mechanism, comprising:

means for maintaining a contact tension between a wiper and a printhead while moving the printhead in a direction that is parallel to a longitudinal axis of the printhead to remove ink residue from the printhead; and means for controllably releasing the contact tension to separate the wiper and the printhead by moving the printhead in a perpendicular direction while moving the printhead in.

33. One or more computer-readable media comprising executable instructions that, when executed, direct one or more processors in an inkjet printing device to:

position a wiper assembly in proximity to printheads of the inkjet printing device;

move the wiper assembly in a direction that is parallel to a longitudinal axis of the printheads to contact the printheads with wipers and clean the printheads; and separate the wipers from the printheads by moving the wiper assembly along an arc path that is defined by the wiper assembly moving in the parallel direction and the wiper assembly moving in a perpendicular direction relative to the printheads.

34. One or more computer-readable media comprising executable instructions that, when executed, direct one or more processors in an inkjet printing device to:

move a wiper in a direction that is parallel to a longitudinal axis of a print head relative to a printhead to contact the printhead and remove ink residue from the printhead; and move the wiper along an arc path defined by the wiper moving in the parallel direction and the wiper moving in a perpendicular direction relative to the printhead to separate the wiper from the printhead.

35. One or more computer-readable media as recited in claim 34, further comprising executable instructions that, when executed, direct the one or more processors to controllably release a contact tension between the wiper and the printhead.

36. A print unit, comprising:

a print module having one or more printheads configured to deposit an imaging medium on a print media;

a wiper assembly having at least one wiper configured to remove imaging medium residue from a printhead when the wiper and the printhead are in contact and when at least one of the wiper and the printhead is moved relative to the other in a direction that is parallel to a longitudinal axis of the printhead; and the printhead is configured to separate from the wiper along an arc path that is defined by the printhead moving in the parallel direction and the printhead moving in a perpendicular direction relative to the longitudinal axis of the printhead.

37. A print unit as recited in claim 36, wherein the print module is configured to move the printhead in the parallel direction such that the wiper removes the imaging medium residue from the printhead, and wherein the print module is further configured to move the printhead in the perpendicular direction to separate the wiper and the printhead.

38. A print unit as recited in claim 36, wherein the print module is configured to move the printhead in the parallel direction such that the wiper removes the imaging medium residue from the printhead.

39. An inkjet printing mechanism, comprising:

at least one printbar assembly;

one or more print modules coupled to the printbar assembly, an individual print module having one or more printheads;

a service station having one or more wiper assemblies, an individual wiper assembly having at least one wiper configured to clean a printhead when the wiper and the printhead are in contact and at least one of the wiper and the printhead is moved relative to the other in a direction that is parallel to a longitudinal axis of the printhead; and the printhead is configured to separate from the wiper along an arc path that is defined by the printhead moving in the parallel direction and the printhead moving in a perpendicular direction relative to the longitudinal axis of the printhead.

40. An inkjet printing mechanism as recited in claim 39, wherein the printbar assembly is configured to move the printhead in the parallel direction such that the wiper cleans the printhead, and wherein the printbar assembly is further configured to move the printhead in the perpendicular direction to separate the wiper and the printhead.

41. An inkjet printing mechanism as recited in claim 39, wherein the printbar assembly is configured to move the printhead in the parallel direction such that the wiper cleans the printhead.

42. A method, comprising:

removing imaging medium residue from a printhead with a wiper by moving at least one of the wiper and the printhead relative to the other in a direction that is parallel to a longitudinal axis of the printhead; and separating the wiper from the printhead by moving the printhead along an arc path defined by the parallel direction and moving the printhead in a perpendicular direction relative to the longitudinal axis of the printhead.

43. A method as recited in claim 42, wherein removing comprises moving the printhead in the parallel direction.

* * * * *